US006520093B1

(12) United States Patent
Merl

(10) Patent No.: US 6,520,093 B1
(45) Date of Patent: Feb. 18, 2003

(54) TRANSFORMING DISPLAY TABLE

(76) Inventor: Milton J. Merl, 267 W. 70th St., New York, NY (US) 10023

( * ) Notice: Subject to any disclaimer, the term of this patent is extended or adjusted under 35 U.S.C. 154(b) by 0 days.

(21) Appl. No.: 09/793,948

(22) Filed: Feb. 27, 2001

(51) Int. Cl.[7] ..... A47B 1/04
(52) U.S. Cl. ..... 108/69; 108/77
(58) Field of Search ..... 108/69, 77, 60, 108/59, 55.1; 248/345.1

(56) References Cited

U.S. PATENT DOCUMENTS 2,358,174 A * 9/1944 McFall
2,758,898 A * 8/1956 Kobsch
4,446,796 A * 5/1984 Wilson et al. ..... 108/69
4,750,432 A * 6/1988 McNamara et al. ..... 108/69

* cited by examiner

*Primary Examiner*—Jose V. Chen
(74) *Attorney, Agent, or Firm*—Schweitzer Cornman Gross & Bondell LLP

(57) ABSTRACT

A multi-use table has a central table flanked by extension wings which are independently positionable in vertical upward, horizontal and vertical downward orientations. A locking device is provided in association with each wing, and may consist of a right-angle arm mounted to a lower surface of the central table for sliding and rotational motion. A distal end of the arm engages the wing for locking purposes. In a preferred embodiment the distal end of the arm is retained in a pocket in the wing between upper and lower wing surfaces.

8 Claims, 8 Drawing Sheets

TRANSFORMING DISPLAY TABLE

The present invention relates to a new and improved table device and particularly to a table which is convertible between a plurality of configurations. The table may be of particular value as a display apparatus for retail sales establishments.

BACKGROUND OF THE INVENTION

Both retailers, distributors and manufacturers have numerous and variable needs for work tables, storage bins, display devices and the like. A retailer, for example, may wish to display product in a stacked arrangement on a flat, tabletop surface, or to have a work surface upon which labeling, wrapping or other procedures can be performed. A retailer may also require bins for sorting and displaying goods. Alternatively, there may also be a need for a display surface or shelf with depending side walls to allow promotional material to be affixed thereto.

In a similar manner, a distributor or manufacturer may require flat work areas for unit product assembly, packaging or the like, as well as bins for the storage of components or products. Further, such work surface, bin units can be more effectively utilized when the unit is movable. Further, efficiency of utilization of such bin, display and work surface can be enhanced when a given unit can be converted from one use to another.

Accordingly, it is a purpose of the present invention to provide a table which may be converted from a flat working surface to a bin with one or more upstanding sides or to a table with depending mounting walls.

A further purpose of the present invention is to provide a table of the aforementioned character which may be easily and efficiently converted from one configuration to another.

Yet a further purpose of the present invention is to provide such a table and structure which may be moved and repositioned as required, and which can interfit and align with other units to provide an increased size work table or structure.

Still another purpose of the present invention is to provide a table having multiple extension wings which can be individually oriented and maintained in a chosen position.

BRIEF DESCRIPTION OF THE INVENTION

In accordance with the foregoing and other objects and purposes, a table in accordance with the present invention comprises a main planar, horizontal work surface mounted to a pedestal-like base. The base may include a lower wheel assembly to allow the table to be moved and repositioned as desired. The main table work surface is bounded by a plurality of edges, along each of which is mounted a pivotable extension wing. Each extension wing is pivotable between raised and lowered vertical positions and a horizontal position. Locking means are associated with the extension wings and allow each of the extension wings to be individually selectively maintained in a chosen orientation. In a preferred embodiment, the locking means are internal to the extension wing, whereby a pair of flat planar opposed surfaces are provided on the faces of the extension wings. Because each of the extension wings is individually adjustable between a plurality of positions, the table is capable of assuming a variety of configurations, providing substantial flexibility in use. In a flat orientation, each of the extension wings may be maintained in the upwardly vertical orientation, forming a bin-like construction. In a second orientation, one or more of the extension wings are horizontal, increasing the flat surface area of the main work surface, with the remaining extension wings positioned either upwardly or downwardly vertical. In a third orientation, all of the extension wings may be in a downwardly vertical position, providing depending faces upon which rocks may be mounted and displayed or other material mounted.

BRIEF DESCRIPTION OF THE DRAWINGS

A fuller understanding of the present invention and the features and benefits thereof will be achieved upon review of the following detailed, but nonetheless illustrative embodiment thereof, when reviewed in association with the annexed drawings, wherein.

DETAILED DESCRIPTION OF THE INVENTION

Figure 1:
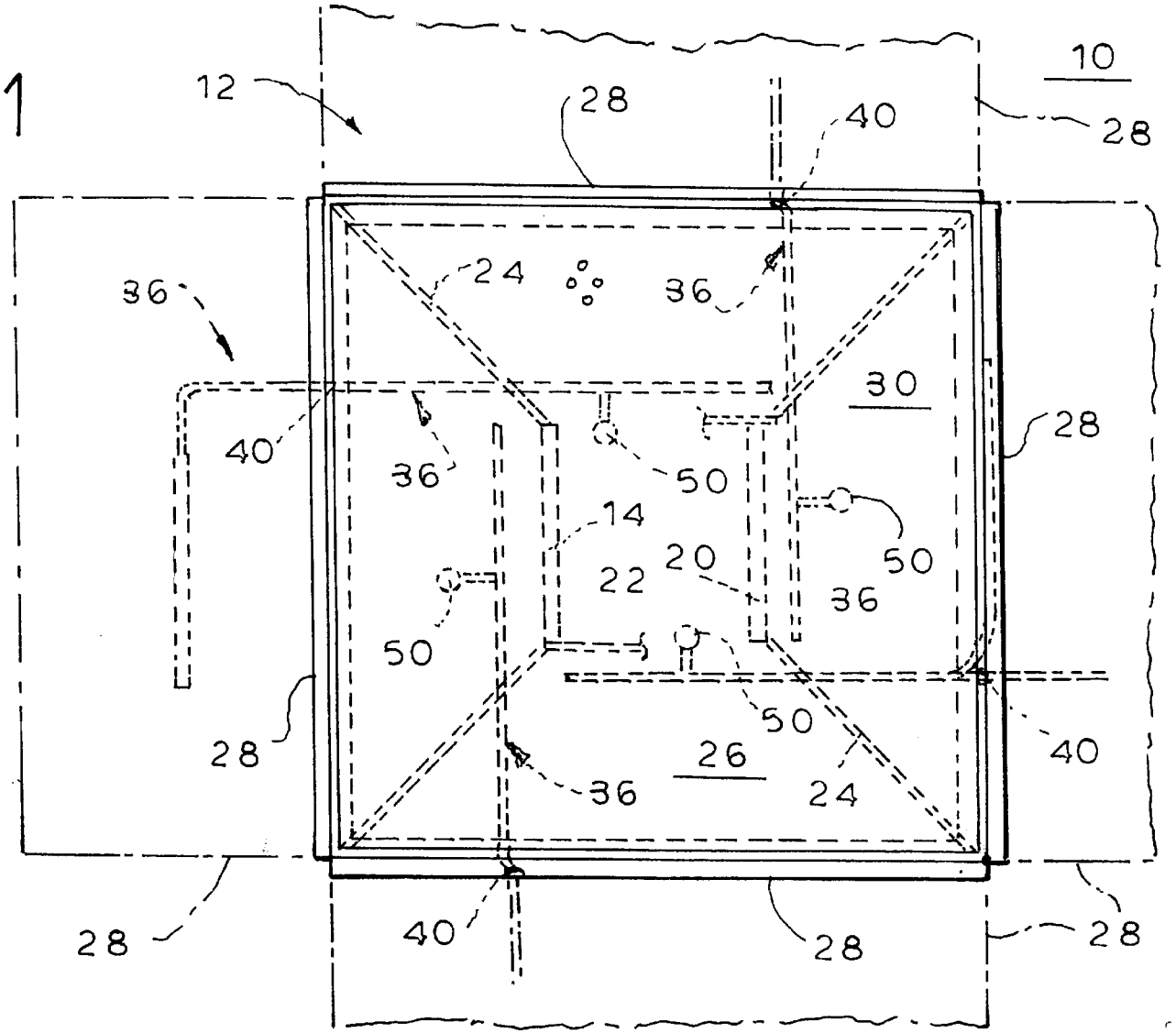
FIG. 1 is a top plan view of a table of the invention, depicting the extension wings in the upwardly-vertical orientation in solid view and in the horizontal orientation in phantom.
Figure 2:
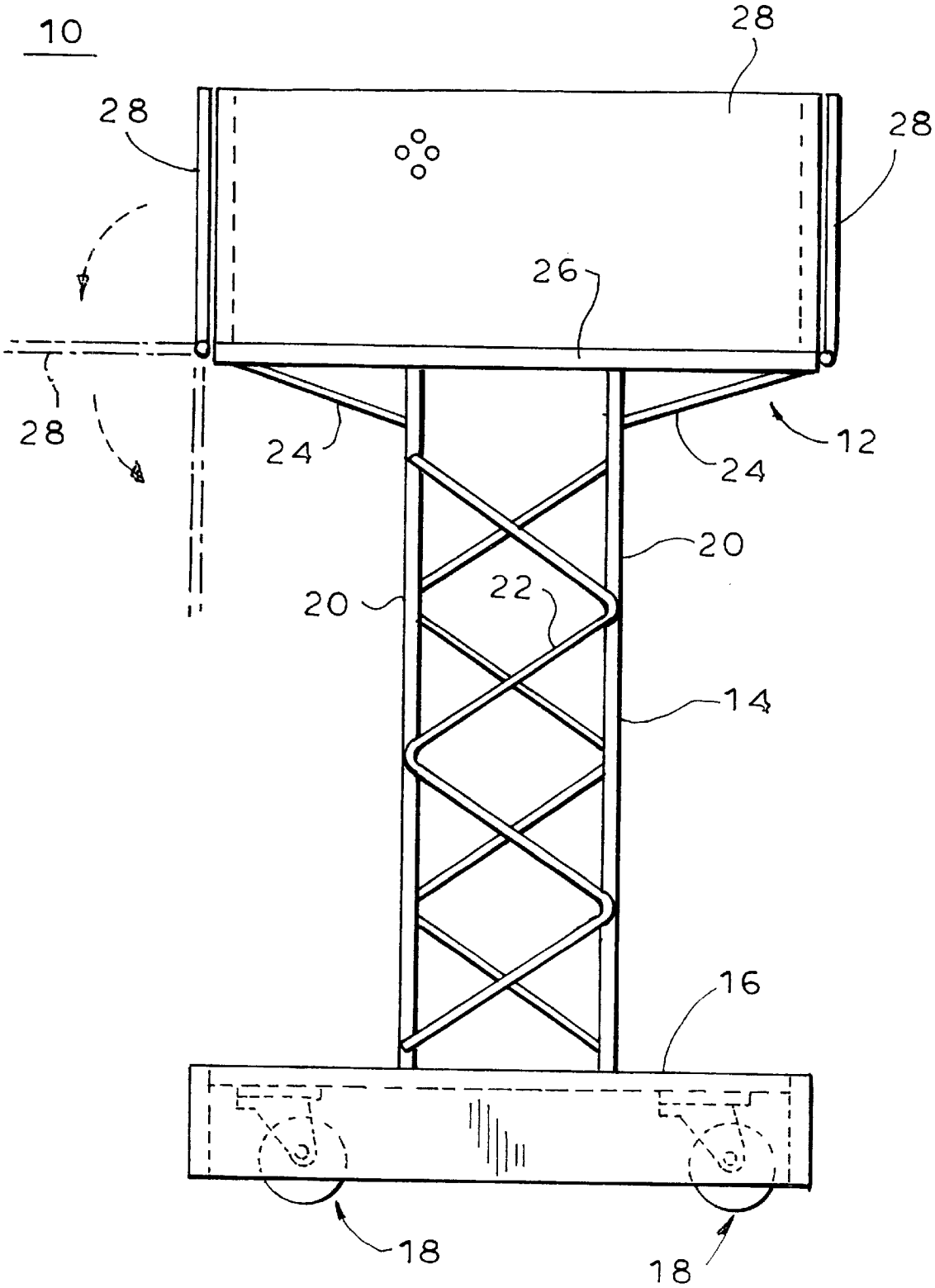
FIG. 2 is a side elevation view thereof.

With initial reference to FIGS. 1 and 2, the multiple-use table 10 of the present invention comprises a tabletop assembly 12 supported by a pedestal 14 upon a base 16. Base 16 may be of conventional construction, including a plurality of casters or wheels 18 to provide mobility for the table. Pedestal 14 may be also of conventional construction, with a pair of opposed side panels 20 joined by reinforcement rods 22. Diagonally-extending wires or rods 24 further brace and support the table top on the pedestal.

Figure 3:
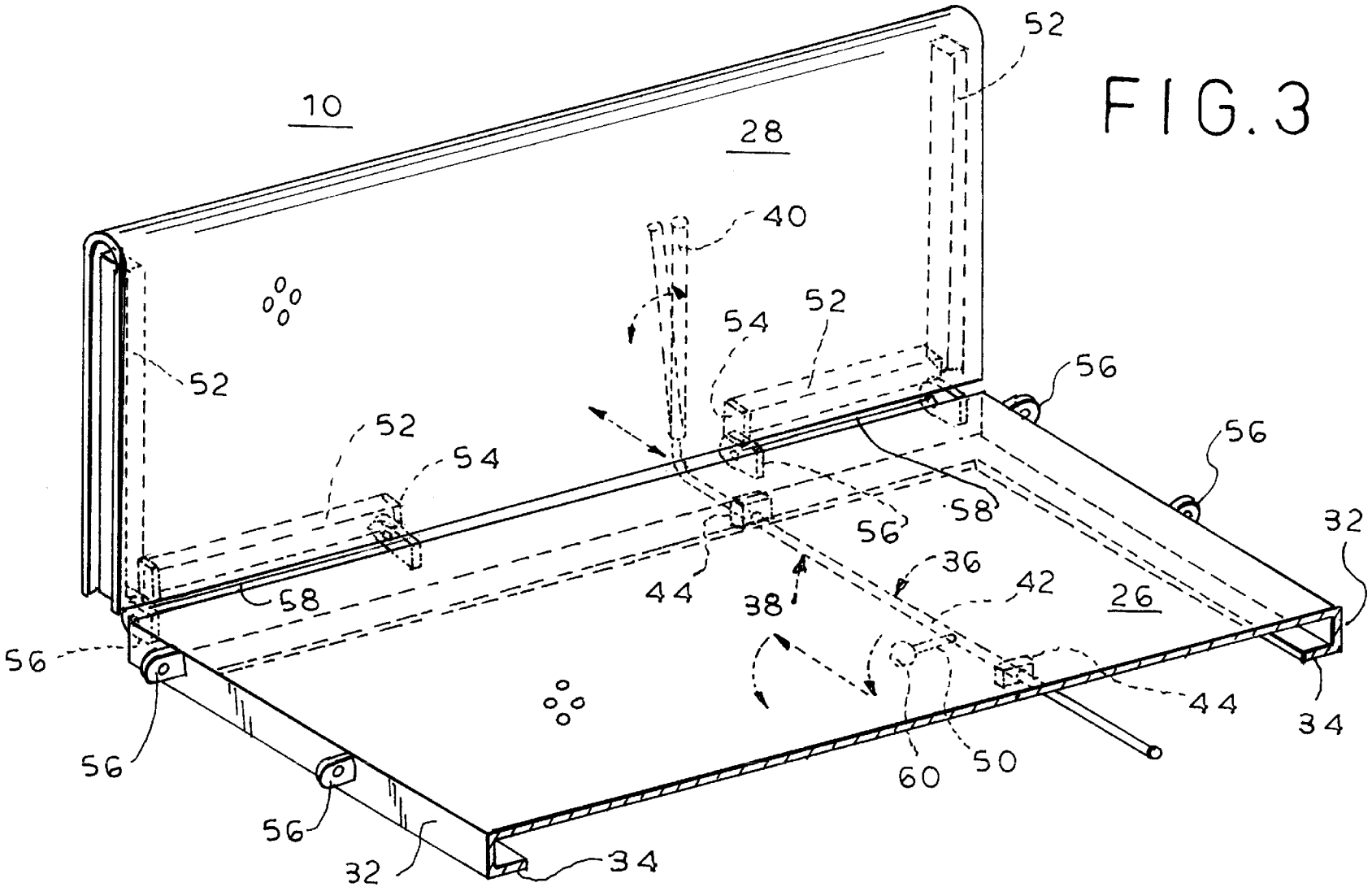
FIG. 3 is a perspective view of a portion of the main horizontal work surface and an extension wing pivotally mounted thereto in the upwards vertical position.

The table top assembly 12 may comprise a main, preferably rectangular or square central table portion 26 and four rectangular extension wings 28 pivotably joined to the edges of the main table portion. As seen in FIG. 3, the main table portion may be formed from sheet steel or aluminum, with a main table surface-forming portion 30, with depending side wall 32 having inwardly-directed lower lip 34. The main table surface portion may be perforated to allow mounting of fixtures, jigs and the like thereon. In FIG. 1 the extension wings are shown extending downward from the main table portion in solid view and extending horizontally outwardly therefrom in phantom. As shown in FIG. 2, each of the extension wings 28 is individually pivotable between upward vertical, horizontal, and downward vertical positions, and is individually maintainable in a chosen one of such positions.

Each of the extension wings 28 is maintained in position by a manually-operable sliding locking mechanism 36 which can engage the extension wing and allows the extension wing to be positioned and maintained as desired. As may be seen in FIG. 3, each locking mechanism 36 is in the form of an angled shaft 38, the distal portion 40 of which being at a right angle to the main portion 42. The main shaft portion is supported by a pair of journal blocks 44 mounted to the bottom of main table surface forming portion 30. The journal blocks permit the locking mechanism to both rotate about the main axis of the main portion 42 and slide parallel to its axis. An operating handle 50 extends from the main shaft portion.

Each of the extension wings 28 is preferably of a layered construction, whereby the top and bottom surfaces forming sections 46, 48 of the extension wing are spaced by spacer blocks 52. In particularly preferred embodiments, the two surface-forming sections are formed from a single U-shaped sheet of material, such as perforated steel or aluminum. The internal edge of the extension wing, abutting the central table portion 26, is formed by the ends of the bent sheet, and may be partially open in the region between a pair of spacer blocks. The open portion provides an access opening for the distal portion 40 of the locking mechanism 36 and the adjacent portion of the main shaft 42, which extend within and between the spaced extension wing surfaces. The distal portion 40 of the locking mechanism may be provided with an increased diameter sleeve or collar, such as of rubber or plastic, to provide a closer tolerance fit between the opposed extension wing surfaces to minimize rattle or shake and to minimize friction as the locking mechanism, is operated.

Each of the extension wings 28 is pivotally mounted to an edge of the main table by a pair of hinge assemblies. Each hinge assembly comprises a pair of hinge brackets 54 which may be mounted to the spacer blocks 52 at the internal edge of the extension wing and extend outwardly therefrom. The main table portion 26 is provided with two pairs of corresponding hinge brackets 56, mounted to the side walls 32 and located to be adjacent the brackets 54 on the extension wing. Hinge rods 58 are mounted in aligned bores in the hinge brackets and complete the hinge assemblies.

FIGS. 4–10 illustrate in sequence the repositioning of one of the extension wings 28 from an upward vertical position to a horizontal position and subsequently to a downward vertical position. The movement and positioning of locking mechanism 36 allows the wing to be released from a chosen position, pivoted to an alternative position, and then retained in the new alternative position.

Figure 5:
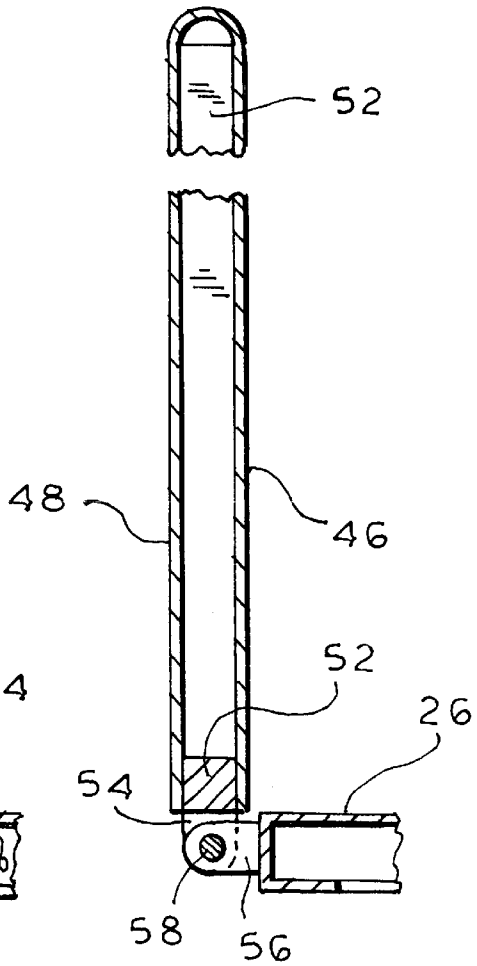
FIG. 5 is an elevation view of the position of FIG. 4.
Figure 4:
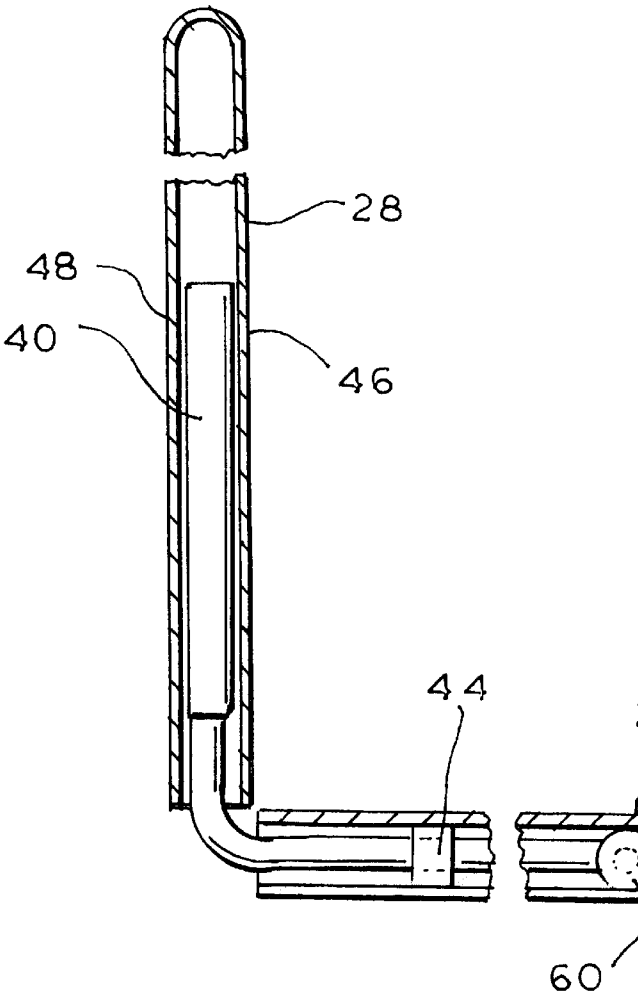
FIG. 4 is a sectional view of a portion of the main horizontal work surface and extension wing in the upwards vertical position.

Referring first to FIGS. 4 and 5, extension wing 28 is shown in the upward vertical position extending above the main table portion 26. Locking mechanism 36 is in a first, retracted position, its distal end portion 40 extending upwardly vertical between the spaced top and bottom surface-forming portions 46, 48 of the extension wing, whereby the wing is retained in a vertical position. The distal end, captured between the spaced portions 46, 48, prevents the wing from pivoting counter-clockwise in the Figure from the vertical position. To insure that the locking mechanism, and particularly the distal end thereof, does not inadvertently rotate into a horizontal orientation, thus freeing the extension wing, the locking mechanism is positioned such that its distal portion 40 assumes an angle of slightly beyond the vertical, as shown in FIG. 3. In such a position the force of gravity tends to rotate the distal portion clockwise in the Figure, while the ball head 60 of operating handle 50 is in contact with the lower surface of the table top, preventing such further rotation and maintaining the locking mechanism, and thus the extension wing, in the vertical position.

Figure 6:
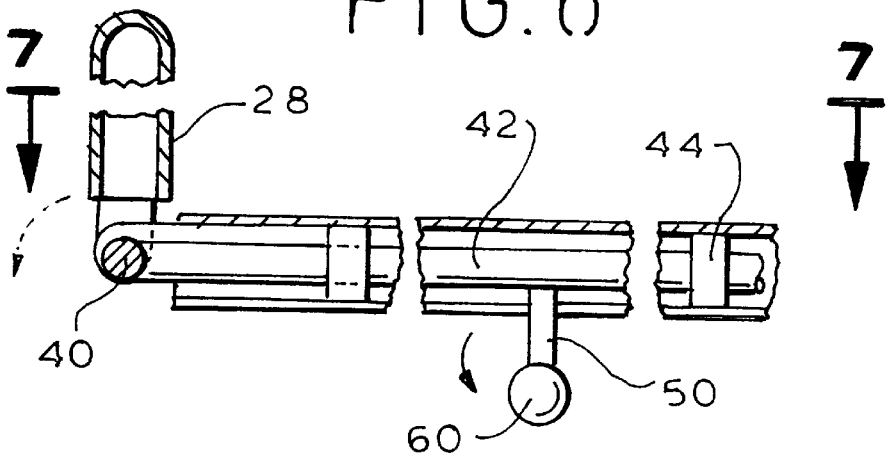
FIG. 6 is another sectional view of the portion of FIG. 4 further depicting the locking mechanism rotated to free the extension wing.
Figure 7:
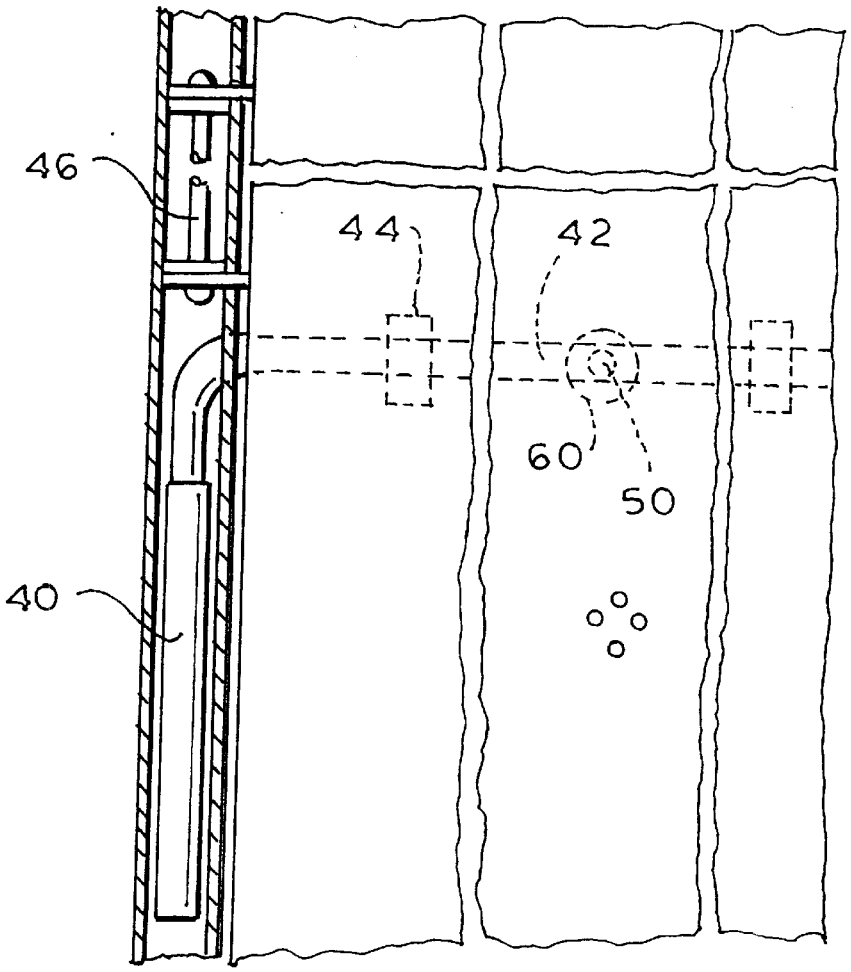
FIG. 7 is a view taken along line 7—7 of FIG. 6.

As shown in FIGS. 6 and 7, when it is desired to lower the extension wing, the locking mechanism 36 is rotated about its main axis in the journal blocks 44 by a counter-clockwise pivoting motion in FIG. 3, such that the distal portion 40 is in a horizontal position as shown in FIGS. 6 and 7. In such a position, the distal portion is clear of the extension wing 28, and is aligned with the axis of the huge rods 46. The extension wing is now free to pivot downwardly about the hinge axis. As seen in FIG. 6, handle 50 is rotated downwardly, away from the lower surface of the main table, and the extension wing is then rotated counterclockwise.

Figure 8:
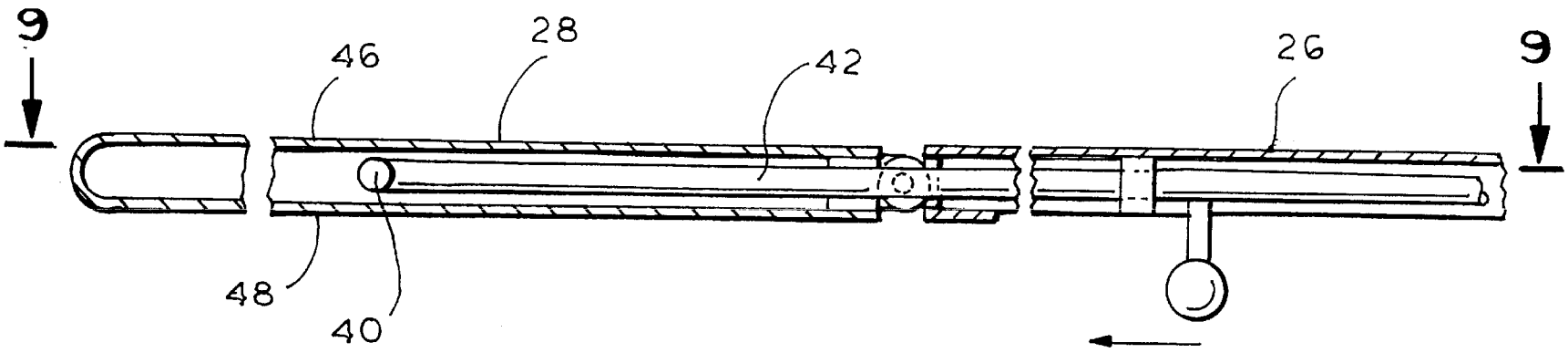
FIG. 8 is yet another sectional view of the portion of FIG. 4 depicting the extension wing reoriented and locked in a horizontal position.
Figure 9:
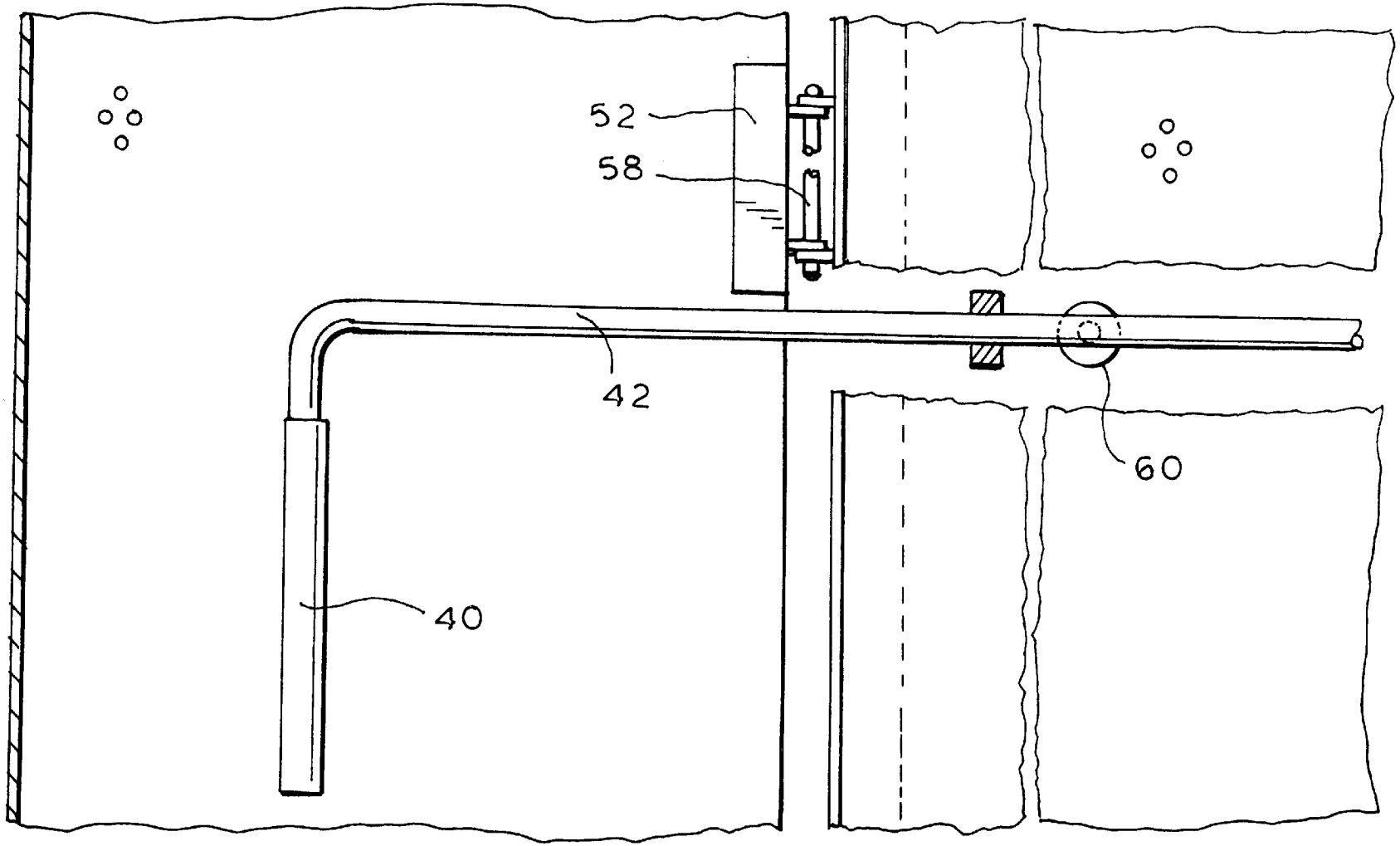
FIG. 9 is a sectional view taken along line 9—9 of FIG. 8.

FIGS. 8 and 9 depict the extension wing rotated into the horizontal position, serving as a flat extension to the main table surface 30. The extension wing is pivoted to the horizontal, and manually held in that position while the locking mechanism 36 is slid longitudinally outwardly along its main axis on the journal blocks 48 as shown by the arrow in FIG. 8. The distal portion 40 of the locking mechanism is horizontal such that it can slide deeply into the space or pocket between the top and bottom surface-forming portions 46, 48 of the extension wing. With the locking mechanism in such a second, extended position, the wing is supported and maintained in the horizontal position by the right angle structure of the locking mechanism.

Figure 10:
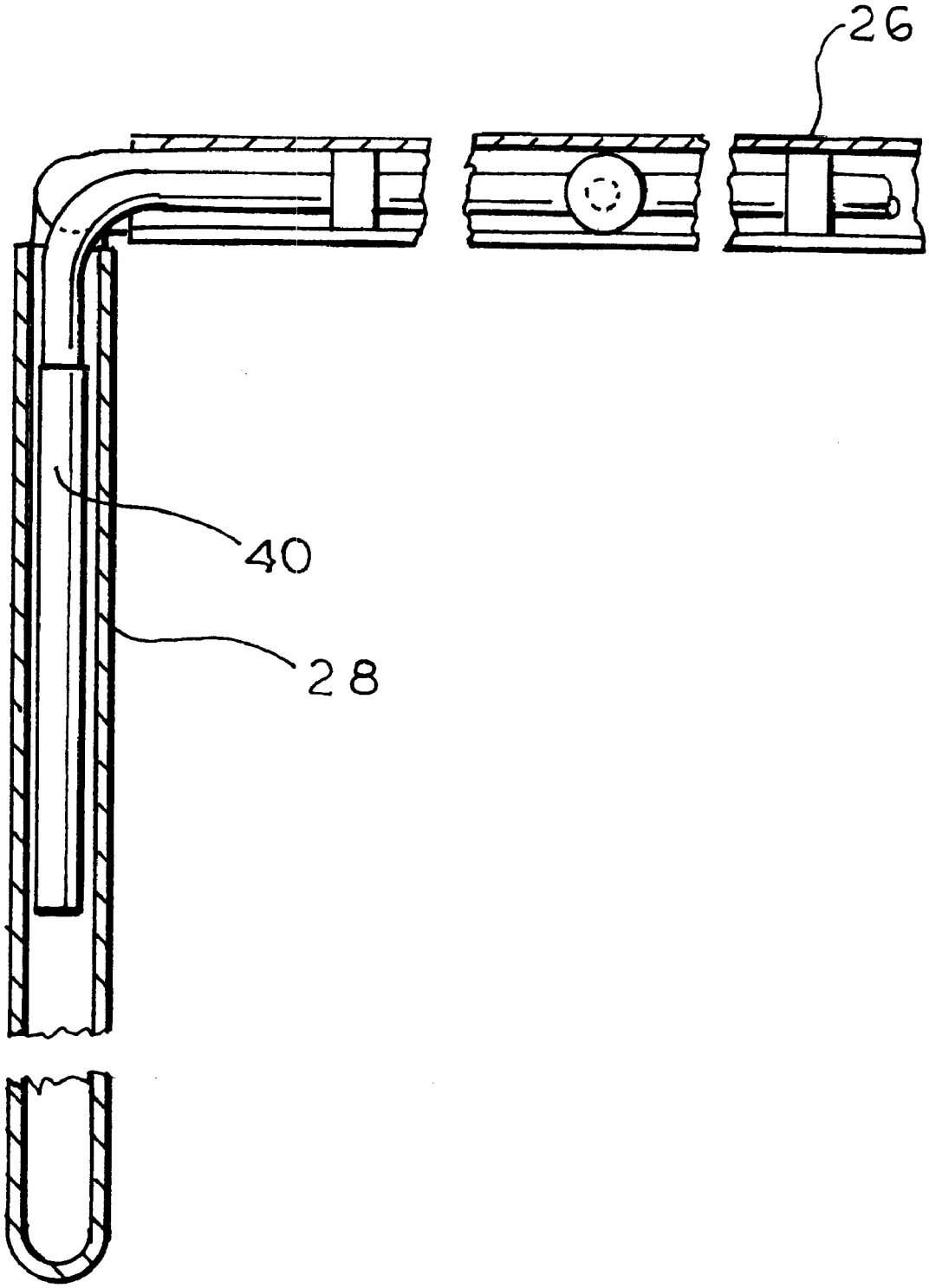
FIG. 10 is yet another sectional view of the portion of FIG. 4 depicting the extension wing locked in the depending vertical position.

When positioning of a wing into a depending vertical orientation, as depicted in FIG. 10, the locking mechanism 36 is retracted from the second, extended position (if the wing is in the horizontal orientation) or rotated (if the wing is in the upward vertical orientation) to the retracted position in which the distal portion 40 is free of the extension wing and aligned with the hinge axis, as seen in FIGS. 6 or 7. The extension wing is then again free to pivot about its hinges to the downward, vertical position. Once in that orientation, the locking mechanism is again rotated such that the distal end 40 thereof pivots downwardly into the extension wing pocket, as seen in FIG. 10, retaining the extension wing in position. When it is desired to unlock the wing for subsequent repositioning, the locking mechanism is again operated to pivot the distal end upward and free of the pocket, aligned with the hinge axis allowing the extension wing to be pivoted as required to an alternative position. The locking mechanism once again is repositioned for engagement with the wing.

I claim:

1. An adjustable table, comprising a central table having a plurality of edges, extension wings mounted to said edges and pivotable between upward vertical, horizontal and downward vertical positions, and a locking mechanism associated with each of the extension wings to selectively maintain the extension wing in a chosen one of the positions, said locking mechanisms each comprising a shaft having a right angled distal portion, the shaft being mounted to a bottom surface of the central table for longitudinal motion and rotation about a main axis, the extension wings having spaced upper and lower surfaces and an internal pocket therebetween with an entranceway located through a side edge of the extension wing for acceptance of the distal portion of the shaft.

2. The adjustable table of claim 1 further comprising a support pedestal mounted to said central Table.

3. The adjustable table of claim 2, wherein the pedestal is mounted upon a wheeled bin.

4. The adjustable table of claim 1 further comprising hinges pivotally joining the extension wings to the central table, the hinges being mounted to the side edges of the extension table between the upper and lower surfaces and being mounted to a depending side wall of the central table.

5. The adjustable table of claim 4, wherein the upper and lower surfaces of the extension wings are formed from a unitary piece of sheet stock.

6. The adjustable table of claim 4, wherein an entrance-way for the pocket is formed between a pair of spacer blocks mounted to the spaced upper and lower surfaces of the extension wings.

7. The adjustable table of claim 4, wherein the shaft is supported in journal blocks mounted to the bottom surface of the central table, the shaft is movable between a first position wherein the distal portion is aligned with a hinge axis of the hinge pivotally mounting the extension wing, a second position wherein the distal portion extends within the pocket, and at least one third position wherein the distal portion is at about a right angle to the hinge axis.

8. The adjustable table of claim 7, wherein a third position for the shaft is with the distal portion extending upward being rotated from the horizontal through an angle slightly greater than 90 degrees, the shaft having stop means for limiting the rotation of the shaft to the slightly greater angle.

* * * * *